US006976652B2

(12) United States Patent
Koreska

(10) Patent No.: US 6,976,652 B2
(45) Date of Patent: Dec. 20, 2005

(54) TOOL FOR TRANSFERRING A FILM

(75) Inventor: Peter Koreska, Vienna (AT)

(73) Assignee: Kores Holding Zug AG, Zur (CH)

( * ) Notice: Subject to any disclaimer, the term of this patent is extended or adjusted under 35 U.S.C. 154(b) by 32 days.

(21) Appl. No.: 10/482,841

(22) PCT Filed: Jul. 5, 2002

(86) PCT No.: PCT/AT02/00196

§ 371 (c)(1),
(2), (4) Date: Jan. 6, 2004

(87) PCT Pub. No.: WO03/011729

PCT Pub. Date: Feb. 13, 2003

(65) Prior Publication Data

US 2004/0182962 A1 Sep. 23, 2004

(30) Foreign Application Priority Data

Jul. 6, 2001 (AT) ..... A 1056/2001

(51) Int. Cl.[7] ..... B65H 49/08
(52) U.S. Cl. ..... 242/588.2; 242/588.3; 156/579
(58) Field of Search ..... 242/588, 588.2, 242/588.3, 916; 156/579, 574, 577, 584, 156/540, 238, 247, 391, 486; 206/391

(56) References Cited

U.S. PATENT DOCUMENTS 2,493,737 A * 1/1950 Burns ..... 156/577
3,150,027 A * 9/1964 Moyer ..... 156/577
3,186,892 A * 6/1965 Walthers ..... 242/588
3,274,038 A * 9/1966 Karn ..... 156/577
3,839,127 A 10/1974 Hazuka et al.
3,902,956 A * 9/1975 Thompson, Jr. ..... 156/577
4,096,022 A * 6/1978 Crawford ..... 156/577
4,486,263 A * 12/1984 Monzo Gomez ..... 156/577
4,540,393 A 9/1985 Knoop (Continued)

FOREIGN PATENT DOCUMENTS

DE 30 25 345 A1 7/1980

(Continued)

*Primary Examiner*—William A. Rivera
(74) *Attorney, Agent, or Firm*—Pillsbury Winthrop Shaw Pittman LLP

(57) ABSTRACT

A hand-operated tool for transferring a film from a tape to a substrate includes a housing from which a film transfer member projects outwards and in which a film supply reel, from which the tape is pulled over the transfer member for transferring the film, and a winding-up reel are rotatably mounted, and a sliding coupling is provided for a torque transmission from the supply reel to the winding-up reel, the empty tape being wound up on the winding-up reel after transfer of the film (11) at the transfer member; at a bottom side of the housing which, when transferring the film to the substrate, faces this substrate, in a transition region between a housing part accommodating the transfer member and a housing part housing the reels, a supporting member defining a tilting support is provided on both sides of the housing main middle plane, which supporting member, in combination with the transfer member, provides a three-point support on the substrate.

11 Claims, 8 Drawing Sheets

U.S. PATENT DOCUMENTS

| | | | | | |
|---|---|---|---|---|---|
| 4,718,971 | A | * | 1/1988 | Summers | 156/540 |
| 5,281,298 | A | | 1/1994 | Poisson et al. | |
| 5,462,633 | A | * | 10/1995 | Manusch et al. | 156/577 |
| 5,507,908 | A | * | 4/1996 | Fukushima et al. | 156/238 |
| 5,806,713 | A | | 9/1998 | Dudley et al. | |
| 5,851,348 | A | * | 12/1998 | Muenzer et al. | 156/577 |
| 6,029,849 | A | | 2/2000 | Meshulam | |
| 6,360,805 | B1 | * | 3/2002 | Takahashi | 156/540 |
| 6,382,291 | B2 | * | 5/2002 | Ronalds | 156/540 |
| 6,510,884 | B1 | * | 1/2003 | Chan | 156/574 |

FOREIGN PATENT DOCUMENTS

| | | | |
|---|---|---|---|
| DE | 36 38 722 | A1 | 11/1986 |
| DE | 196 05 811 | C1 | 7/1996 |
| EP | 0 104 989 | A2 | 4/1984 |
| JP | 5-318989 | | 12/1993 |
| JP | 10-181289 | | 7/1998 |
| JP | 10-236081 | | 9/1998 |
| WO | WO 97/46475 | | 12/1997 |
| WO | WO 99/37569 | | 7/1999 |

* cited by examiner

TOOL FOR TRANSFERRING A FILM

This is the U.S. National Stage of International Application No. PCT/AT02/00196, filed on Jul. 5, 2002, which, in turn, derives benefit from Austrian Patent Application No. 1056/2001, filed Jul. 6, 2001.

The invention relates to a hand-operated tool for transferring a film from a tape to a substrate, said tool comprising a housing from which a film transfer member projects outwards and in which a film supply reel, from which the tape is pulled over the transfer member for transferring the film, and a winding-up reel, preferably coaxially to the supply reel, are rotatably mounted, and a sliding coupling provided for a torque transmission from the supply reel to the winding-up reel, the empty tape being wound up on the winding-up reel after transfer of the film at the transfer member.

Such a hand-operated tool, i.e. for transferring an adhesive film from a carrier tape to a substrate, is known from DE 196 05 811 C1; comparable hand-operated tools are used for transferring a correcting material film to a paper substrate so as to cover parts, such as signs or lines, thereon. Examples of such hand-operated tools which are also called "correcting roller" are disclosed in WO 97/46475 A and in WO 99/37569 A.

When transferring a film to a substrate by means of the transfer member of such a hand-operated tool, one is faced with the problem that the hand-operated tool with its housing must be precisely held and guided, unintentional lateral tilting of the housing occurring easily, which, in turn, i.a. will result in that the film is pressed with insufficient strength against the substrate. In WO 99/37569 A a pivotal mounting of the transfer member in the housing has already been suggested, whereby the transfer member can always be held planar on the substrate; this, however, gives rise to a comparatively complex construction, while nevertheless the uniformity of the pressure applied to the film—via the transfer member—during the transfer of the film to a substrate will still solely depend on the practice of the person using the hand-operated tool. This disadvantage also applies if the film to be transferred is an adhesive film which is provided on a carrier tape and is transferred from there to the substrate by means of a transfer member, cf. also DE 36 38 722 C in addition to the previously mentioned DE 196 05 811 C. To a lesser degree this also is true if a film strip is provided without a carrier tape and as such is transferred to the substrate, e.g. in the form of a self-adhesive strip, as disclosed e.g. in DE 30 25 345 C, or when tags are detached from a carrier tape and are transferred to a substrate, e.g. as in the tools according to U.S. Pat. No. 5,806,713 A and U.S. Pat. No. 6,029,849 A. Besides, the hand-operated tool shown in DE 36 38 722 C (similarly also the hand-operated tools according to U.S. Pat. No. 3,839,127 A and EP 104,989 A) has a bottom region facing the substrate during transfer of the adhesive strip, with which bottom region it could be applied on the substrate when used, yet then it will be difficult to exert a controlled pressure on the transfer member and via the latter on the adhesive strip, so that the adhesive strip would poorly adhere to the substrate. On the other hand, in the tools according to U.S. Pat. No. 5,806,713 A and U.S. Pat. No. 6,029,849 A, drive rollers are provided on the tool bottom side which are provided for a frictionally engaged transport of the carrier tape by the tool. Therefore, these drive rollers must be particularly pressed against the substrate when the tool is being used so as to rotatably drive them when displacing the tools; one problem here is to press the transfer edge simultaneously uniformly against the substrate, which, however, is less critical with the comparatively stable labels concerned which have a body, than with a thin film material, in particular a correcting material which, when irregularly pressed against the substrate, will immediately result in a faulty coverage of the desired substrate region.

Finally, a different type of hand-operated tool is known from JP 5-318989 A; this tool serves to transfer symbols from a tape to a substrate, one tape portion each being pressed on by means of a broad roller, being cut off by means of a blade, and finally being manually detached from the substrate, leaving behind the symbol. Furthermore, the tool has two lateral running rollers on the rear housing end which, however, on account of their positions, render a uniform transfer of the tape portions more difficult.

It is now an object of the invention to provide a hand-operated tool of the initially defined type, with which a uniform, equal pressing of the film to the substrate is achieved across the film width in a simple manner, without requiring a pivotal mounting of the transfer member, and with which also the pressure on the transfer member can well be kept constant when transferring greater film lengths, without requiring special practice on the part of the user.

The hand-operated tool of the initially defined type and provided according to the invention is characterized in that at a bottom side of the housing which, when transferring the film to the substrate, faces this substrate, in a transition region between a housing part accommodating the transfer member and a housing part housing the reels, a supporting means defining a tilting support is provided on both sides of the housing main middle plane, which supporting means, in combination with the transfer member, provides a three-point support on the substrate. With this design, the aforementioned object is met in an advantageous manner, and by this "three-point support", a stable, uniform guidance of the hand-operated tool during the transfer of the film to the substrate is achieved, without an undesired lateral tilting of the housing in the region of the transfer member, the transfer member always resting planar on the substrate even if it is rigidly arranged in the housing. Of course, the supporting means need not be exactly punctiform, much rather they can be formed by line-shaped, possibly even two-dimensional regions which, however, naturally must be in one plane and should not be too large (wide) so that they can provide the "three-point support", and, moreover, for the housing, these support regions of the supporting means form a tilting support with an axis about which the housing—which acts as handling means, or grip part, respectively—can be tilted for pressing the transfer member onto the substrate; on account of the lever length given thereby—corresponding to the distance between the transfer member, in particular its transfer edge in case of a wedge-shaped transfer member, and the tilting axis which also is located in front of that region where the tool is gripped, i.e. in front of the reel accommodating housing part—the pressure exertion can well be controlled.

When transferring the film to the substrate, the hand-operated tool is moved over the substrate, as usual, and in addition to the tansfer member, it will also rest on the substrate with the supporting means that project downwards from the housing. In order not to impede the movement over the substrate, it should be possible to move the supporting means as smoothly as possible over the substrate, and for this purpose, it is advantageous if the supporting means is formed by at least one sliding surface molded to the housing and preferably widened as compared to the housing. For the desired tilting of the housing about the sliding faces, for a controlled pressing on of the transfer member, it is furthermore suitable if the sliding surface is designed in the form of arcuate sliding skids (in the lontigudinal direction of the tool).

On the other hand, the movement of the hand-operated tool over the substrate just as the aforementioned tilting are particularly assisted if the supporting means is formed by at least one roller mounted on the housing, e.g. on an axle. In this manner, when using the hand-operated tool, not only a simple rolling on the substrate becomes possible, but such a roller also particularly promotes a "tilting" of the housing with a view to a uniform pressing of the transfer member onto the substrate.

A design of particularly simple construction can be obtained if the roller is snapped into an undercut housing recess.

For a controlled guidance of the movement during the application of the film, e.g. when a correction is to be made in the direction of application (i.e., a change of direction), it is advantageous if the supporting means is formed by two rollers laterally mounted on the housing. In this instance, it is also suitable if the two rollers are fitted onto an axle which passes through the housing. Furthermore, for an efficient construction it is advantageous if the axle in the housing interior at the same time supports the transfer member.

On the other hand, it is also advantageous for a simple design of the housing if the two rollers are put onto separate lateral axles.

For mounting the roller(s), it is, furthermore, suitable if the roller(s) is (are) attached in snap fit on the (respective) axle, or if the lateral rollers are inserted, e.g. snapped, into undercut recesses of the housing, respectively.

As regards a particularly simple construction of the housing as well as of the supporting means which is well suited for a production by injection-molding, it is, moreover, particularly preferred if the rollers are arranged on an axle mounted on the lower side of the housing. For a simple mounting, it may, furthermore, be provided that the axle is snapped into bearing projection provided on the lower side of the housing. Furthermore, it is particularly suitable for production as well as for mounting purposes if the rollers are integrally formed with the axle, e.g. as an injection-molded part.

The invention is usable with particular advantage in the transfer of a correcting material film from a carrier tape to the substrate, since there, due to the sensitive, easily tearable material, a particularly uniform pressure exertion is important. By way of a precaution, it should be mentioned that many types of the mechanisms to be provided here and including a supply reel, a sliding coupling and a winding-up reel are as such known from the prior art, e.g. from the initially mentioned documents WO 97/46475 A and WO 99/37569 A, so that such a mechanism comprising a sliding coupling via which the winding-up reel is driven from the supply reel such that the tape, which is drawn off with the film oriented towards the transfer member by pressing the latter onto the substrate, is kept tensioned and is transported to the winding-up reel that simultaneously is driven by the supply reel, need not be explained in more detail here. The winding-up reel has a larger diameter than the supply reel so that it must slip relative to the supply reel, the slip torque being chosen in relationship to the tension of the tape, without the latter being able to tear. The supply reel and the winding-up reel may be arranged coaxially, or they can also be accommodated in the housing side by side, on parallel axes.

In the following, the invention will be explained in more detail by way of preferred exemplary embodiments to which, however, it shall not be restricted, and with reference to the drawings. In detail, FIG. 1 shows an illustration of a hand-operated tool for transferring a film to a substrate and comprising a supporting means in the form of two rollers;

Figure 1:
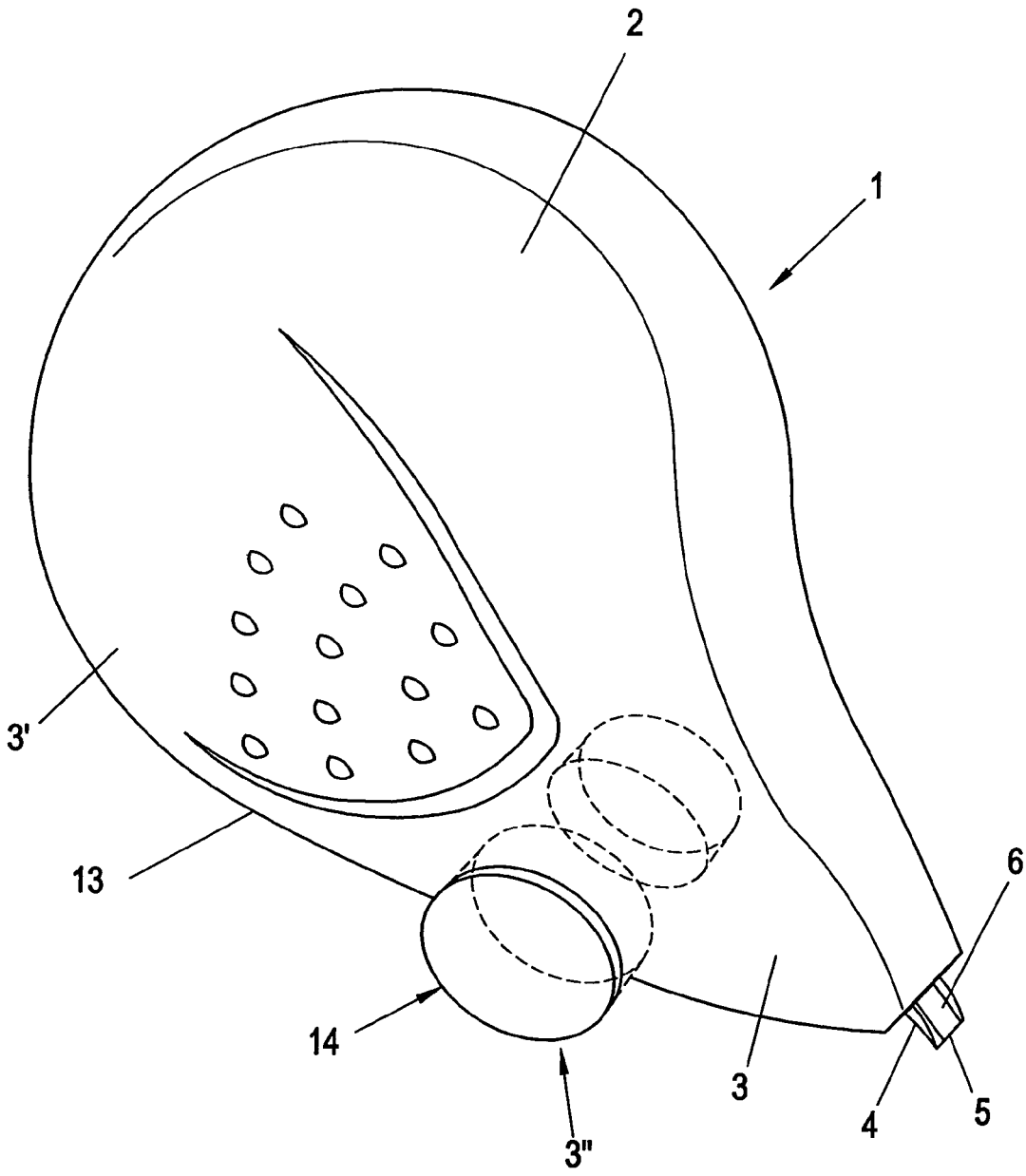

The hand-operated tool 1 illustrated in FIGS. 1 to 6 comprises a housing 2 shaped to be comfortably held and serving as a handling means which commonly is formed of two shell-shaped housing halves (not shown in FIGS. 1 to 6, yet cf. FIG. 13 and WO 97/46475 A, respectively) and includes a tongue-shaped transfer member 4 located in a narrower, forwardly arranged wedge-shaped housing part 3, which transfer member protrudes from the interior of the housing 1 through an opening, not further illustrated, located in its front housing part 3, to the outside. This transfer member 4 has a front transfer edge 5, and a tape 6, which is reeled off a supply reel contained in the interior of housing 2 (cf. also FIG. 9 in addition to FIGS. 2 and 4), extends over this transfer edge 5. The supply reel 7 is rotated as the tape 6 is drawn off and drives a winding-up reel 9 via a sliding coupling 8 merely quite schematically illustrated in FIG. 10, which winding-up reel 9 has a larger diameter than the supply reel 7 and on which the empty carrier tape 6 is wound up after the film originally present thereon, of a white coating or correcting material, e.g., has been transferred to a substrate 10 (cf. FIG. 2, e.g.).

Figure 2:
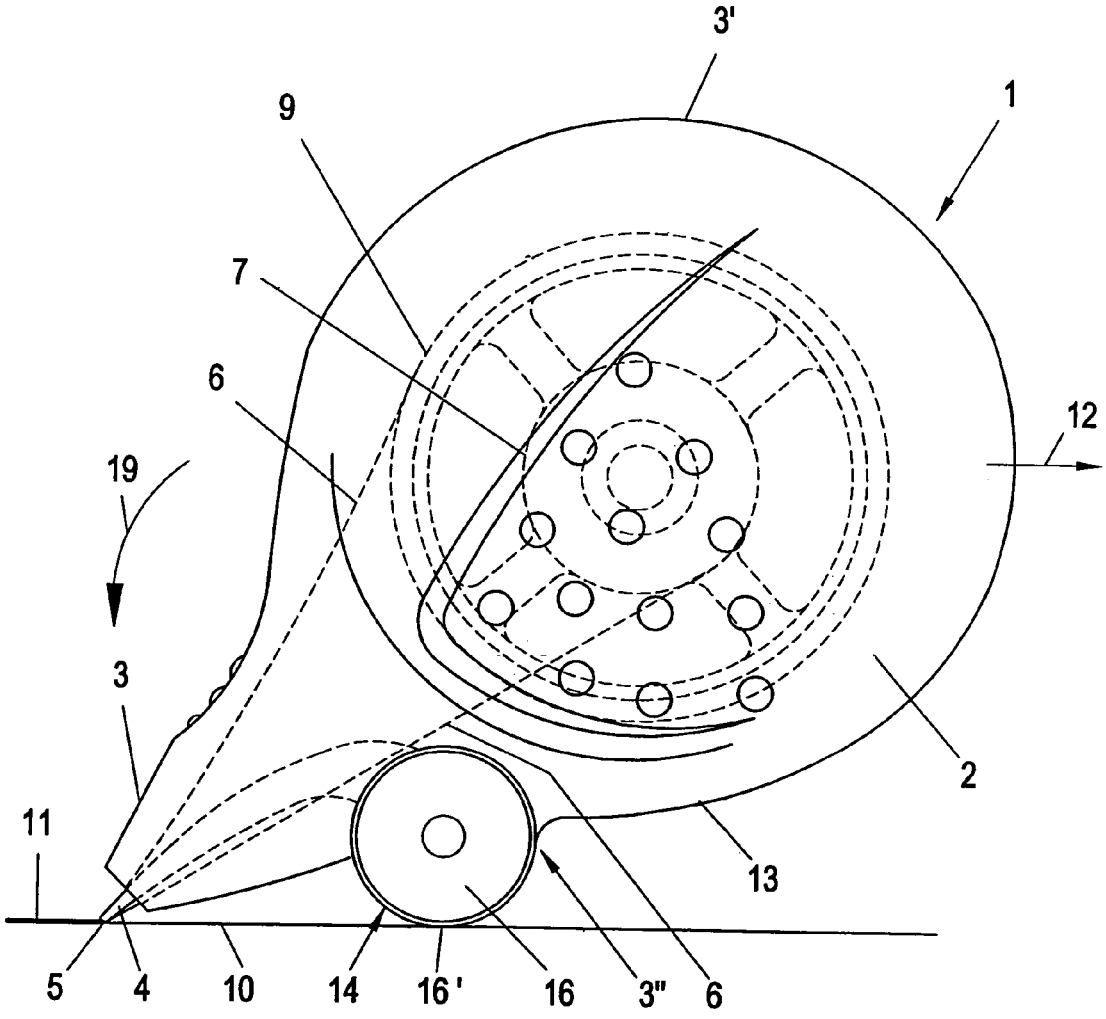
FIG. 2 shows a side view of this hand-operated tool.
Figure 4:
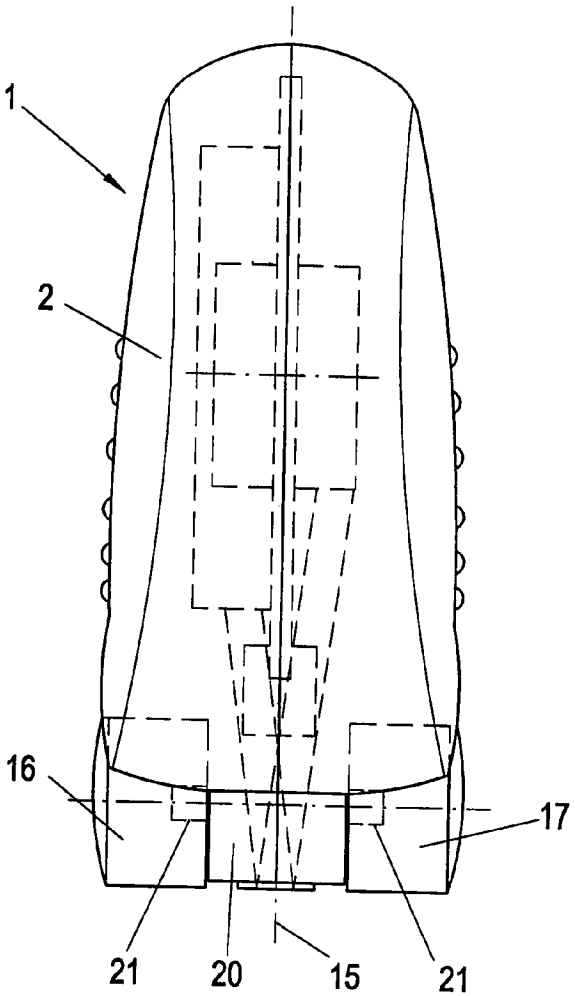
FIG. 4 shows a rear view of this hand-operated tool.
Figure 3:
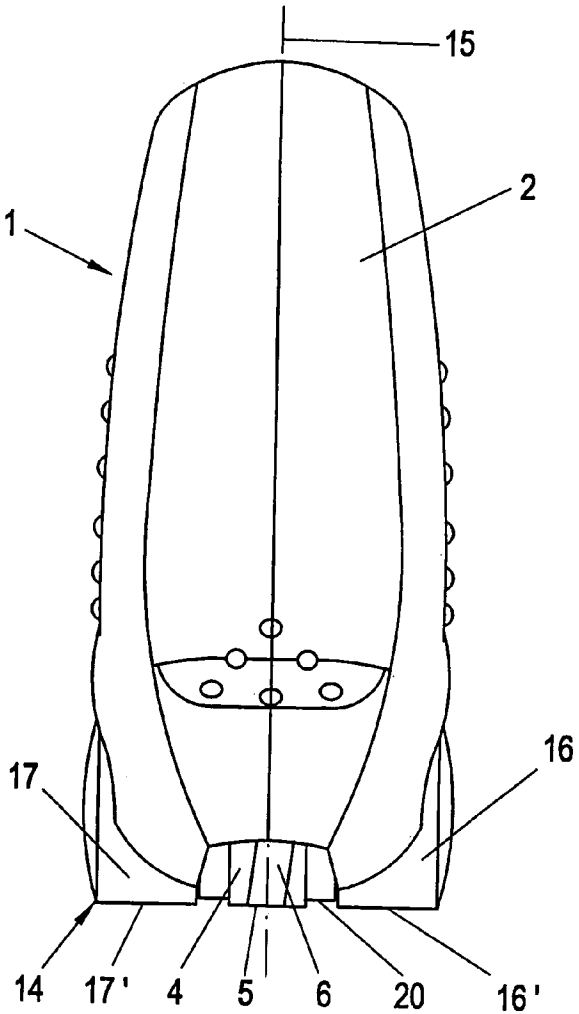
FIG. 3 shows a front view of this hand-operated tool.

In FIG. 2, a correcting material film 11 which has already been transferred to the substrate 10 is schematically illustrated. The supply reel 7 and the winding-up reel 9 preferably are arranged co-axially, as is known per se (cf. also FIG. 10).

According to FIG. 2, the hand-operated tool 1 is moved towards the right in the direction of arrow 12 as the film 11 is being applied to the substrate 10. To apply a uniform, well-controlled pressure on the transfer member 4, or on its transfer edge 5, respectively, during this movement for the purpose of detaching the film 11 from tape 6 and to obtain its complete, qualitatively perfect transfer to the substrate 10, wherein, moreover, also an increased pressure is to be achieved by means of a lever action, a supporting means 14 is provided in the present hand-operated tool 1, at a distance from the transfer member 4 on the bottom side 13 of the hand-operated tool 1—i.e. on that side which faces the substrate 10 when used according to FIG. 2, the hand-operated tool 1 being additionally supported on the substrate 10 by this supporting means. In the embodiment according to FIGS. 1 to 6, this supporting means 14 is formed by rollers 16, 17 arranged on either side of the main middle plane 15 (cf. FIGS. 3 and 4). When transferring the film 11, these two rollers 16, 17 roll on the substrate 10, their contacting regions 16', 17' on the substrate 10 in combination with the transfer member 4, or its transfer edge 5, respectively, defining a kind of three-point support on the substrate 10, as is schematically illustrated also on the whole at 18 in the bottom view in FIG. 7 in a somewhat modified embodiment, yet with similar line-shaped contacting regions 16', 17' and with the transfer edge 5. From the illustration of FIG. 2 it is furthermore clearly visible that when the hand-operated tool 1 is tilted with its housing 2 about the rollers 16, 17 towards the left, i.e. in counter-clock-wise direction, according to arrow 19, the pressure on the transfer member 4 is increased, and on account of the lever action according to the lever with the distance between the rollers 16, 17 and the transfer member 4, a uniform, enhanced, well-controllable pressure can be exerted. For this purpose it is also important that both the transfer edge 5 and the supporting means 14, i.e. the roller 16, 17, are arranged substantially in front of that housing part 3' which is gripped with the hand when handling the tool, i.e. that (main) housing part 3' in which the reels 7, 9 are housed. As apparent from FIGS. 1 and 2, e.g., the supporting means 14 is arranged in the transition region 3" between the front housing part 3 (with the transfer member 4) and the reel-accommodating housing part 3'.

Figure 5:
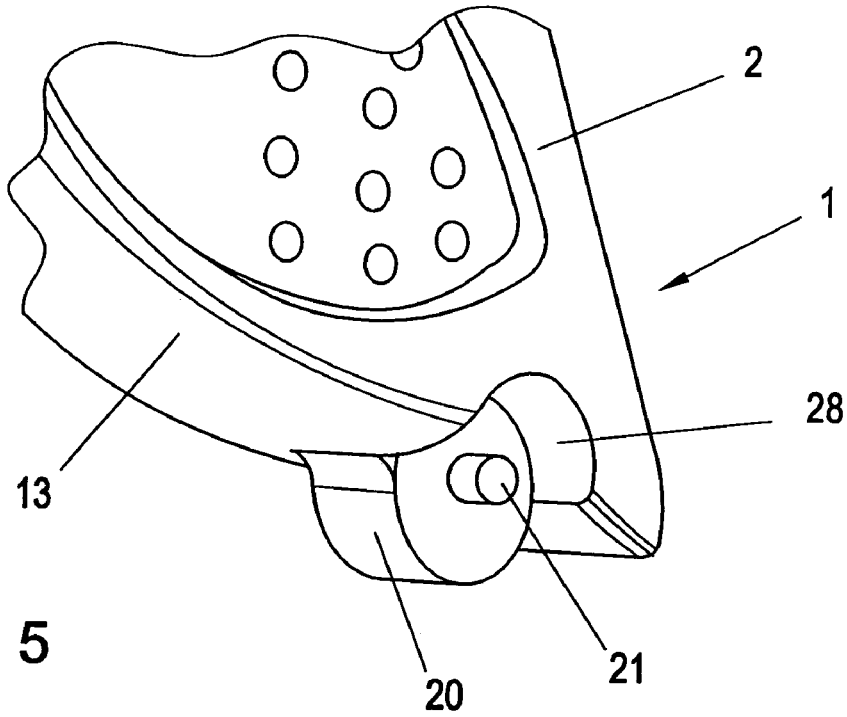
FIGS. 5 and 6 are perspective views of the front bottom region of this hand-operated tool in the region of the supporting means, the hand-operated tool being illustrated without rollers in FIG. 5 and with rollers in FIG. 6.
Figure 6:
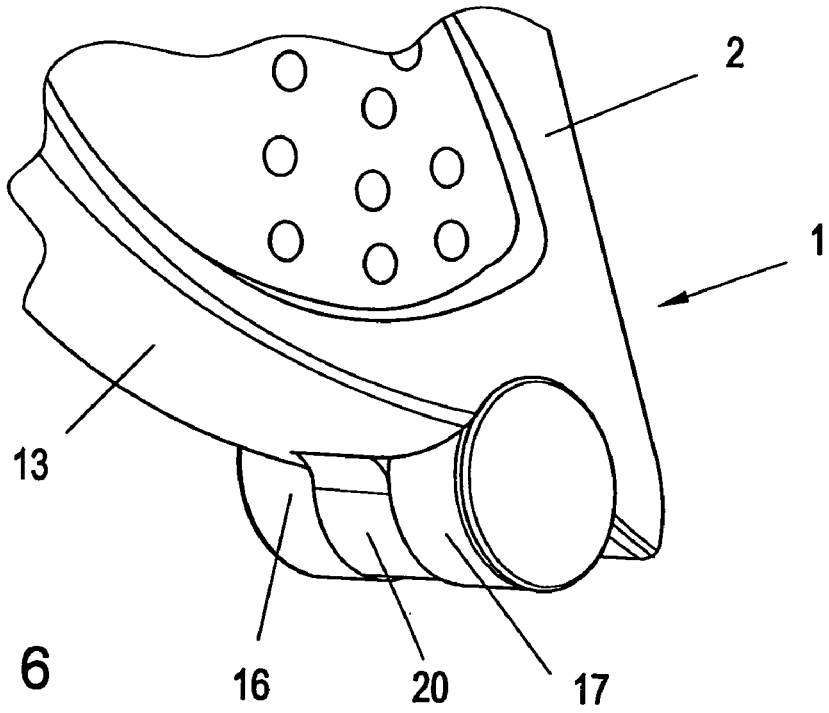

From FIGS. 5 and 6 it can be seen that a bearing member 20 is molded to the bottom side 14 of the housing 2 for mounting the rollers 16, 17. According to FIG. 5, this bearing member 20 has an integral axle 21 on each side thereof (only one visible in FIG. 5), the two rollers 16, 17 being slipped onto these axles 21 in a snap fit (not further illustrated) according to FIG. 6.

Due to the three-point support 18 described, the transfer member 4 can also be rigidly attached in housing 2 without any problems, planar pressing on the substrate 10 nevertheless being also feasible by non-practiced persons.

Figure 7:
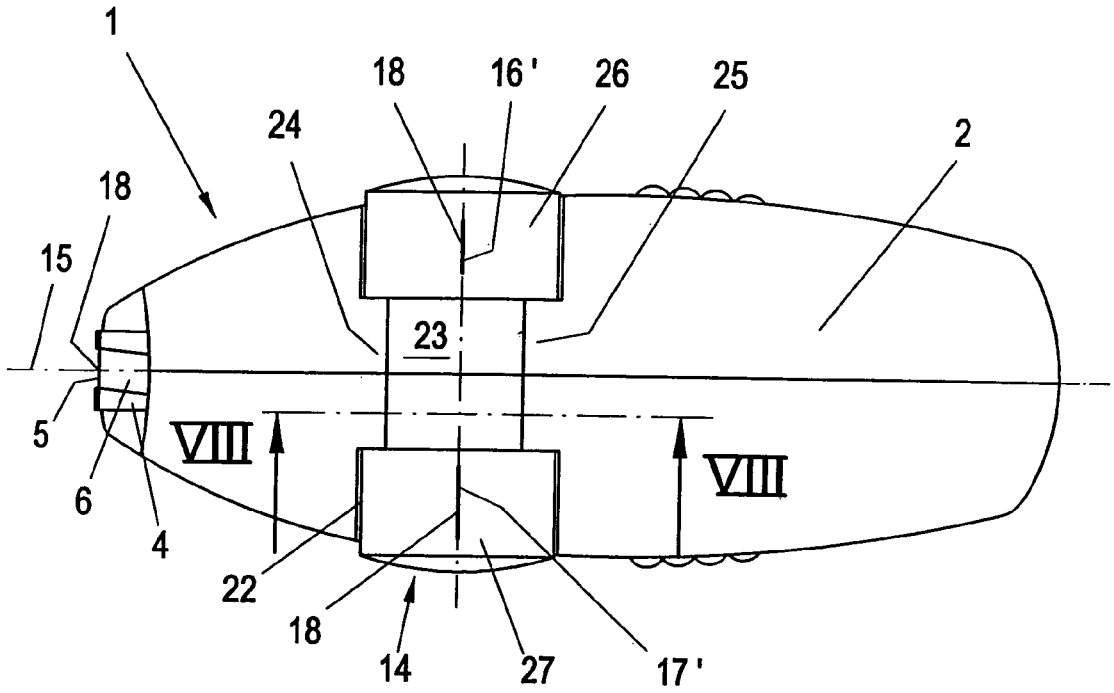
FIG. 7 shows the bottom side of a hand-operated tool somewhat modified when compared with FIGS. 1 to 6.
Figure 8:
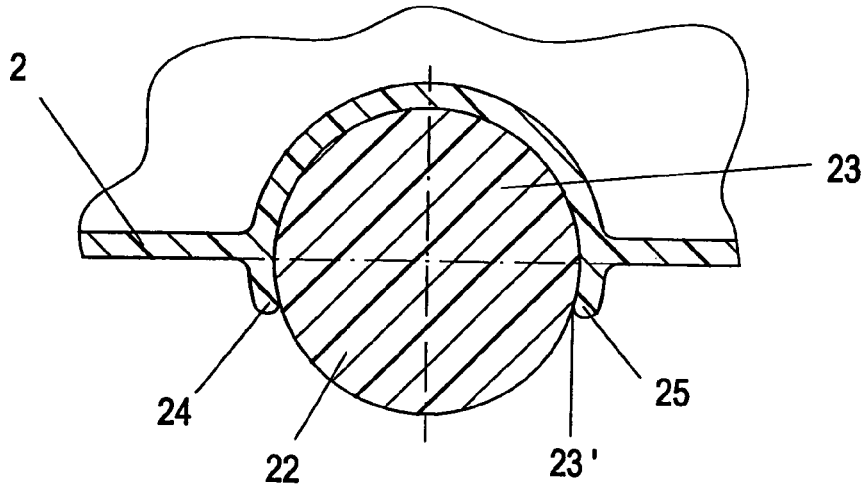
FIG. 8 shows a partial section through the region of the supporting means of this hand-operated tool, according to line VIII—VIII of FIG. 7.

According to FIGS. 7 and 8, a one-piece roller 22 is provided as the supporting means 14, which roller has a reduced diameter in its middle region 23, and with this reduced-diameter region 23 it is snapped into an undercut housing recess formed by two arcuate, lobe-shaped housing projections 24, 25. The housing projections 24, 25 together with the remaining receiving opening in the housing thus form circular-arc-shaped bearing members for the cylindrical, reduced-diameter roller region 23. Laterally of the latter, enlarged-diameter roller regions 26, 27 are present which are comparable to the rollers 16, 17 in the exemplary embodiment according to FIGS. 1 to 6, forming the three-point support 18 together with the transfer part 4, or its transfer edge 5, respectively. The housing projections 24, 25 extend substantially comparable to the roller bearing recesses 28 visible in FIG. 5 adjacent the bearing part 20, yet in the middle region of the housing 2, on either side of the middle plane 15, and, furthermore, across the middle of the circle defined by the reduced-diameter roller region 23 to thus retain the roller 22 with its region 23 in an undercut housing recess 23'.

Likewise, it would also be conceivable to snap the rollers 16, 17 of the embodiment according to FIGS. 1 to 6 into undercut housing recesses comparable to the bearing recess 28, instead of snapping them onto the axles 21. For this purpose, the bearing recess 28 in the illustration of FIG. 5 would only have to be extended downwards to beyond the middle of the circle by means of a housing projection so as to arrive at the undercut shape.

Figure 9:
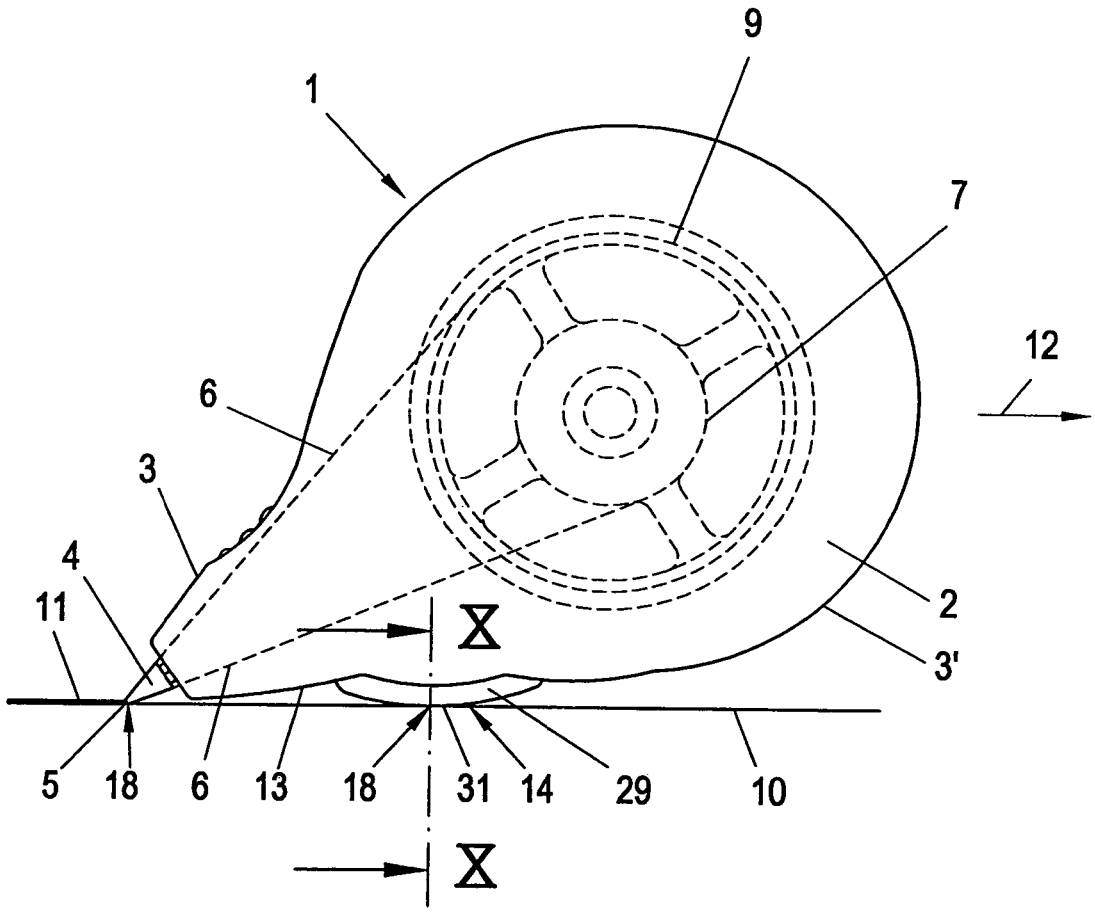
FIG. 9 shows a side view of a further hand-operated tool comprising sliding skids as supporting means.
Figure 10:
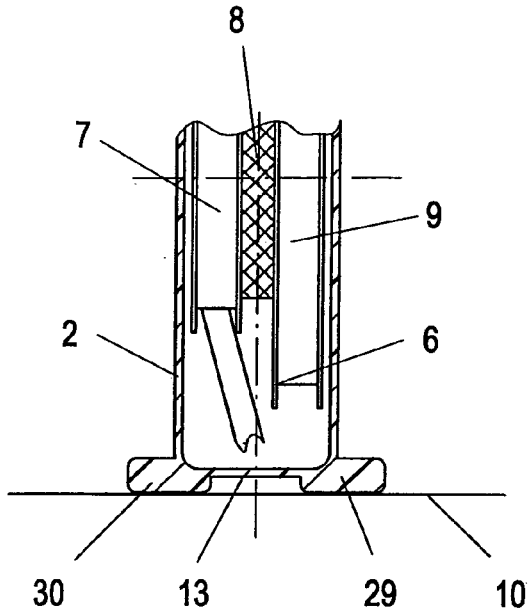
FIG. 10 shows a cross-section through the lower part of this hand-operated tool in the region of the sliding skids, according to line X—X of FIG. 9.

In the embodiment of the hand-operated tool 1 according to FIGS. 9 and 10, the supporting means 14 for the hand-operated tool 1 and for the aforementioned three-point support 18 is formed by sliding skids 29, 30 which together define a sliding surface 31. The sliding skids 29, 30 are laterally externally integrally molded to the lower side 13 of the housing 2, and preferably they have an arcuate lower side so as to facilitate sliding and tilting of the hand-operated tool 1 on the substrate 10.

Figure 11:
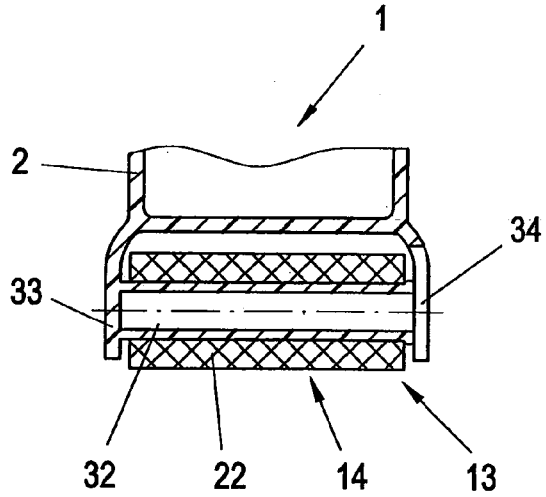
FIGS. 11, 12 and 13 show three further embodiments of the supporting means in sectional views of the housing bottom region comparable to FIG. 10, i.e. in the form of a single roller (FIG. 11), in the form of two rollers slipped onto a single, continuous axle (FIG. 12), and in the form of two rollers designed in one piece and including an axle rotatably mounted on the housing lower side.

In FIG. 11, an embodiment of a hand-operated tool 1 with a single roller 22 is shown, which is modified relative to FIG. 7 insofar as here this roller 22 is snapped onto a single axle 32. This axle 32 freely cantilevers on a lateral housing lobe 33 on the lower side 13 of the housing, a corresponding opening 34 being provided in housing 2 on the opposite side, through which the roller 22 can be snapped onto the axle 32.

Figure 12:
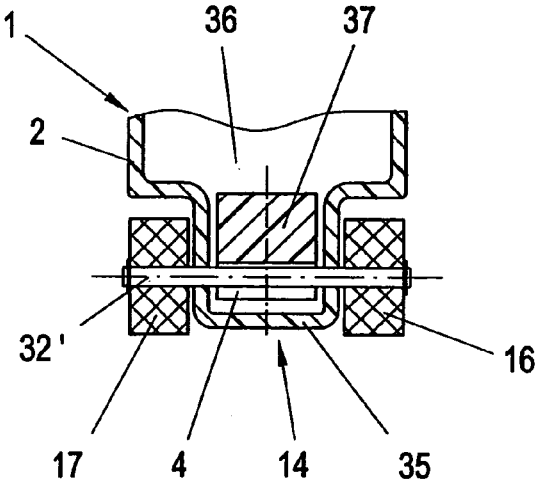

In the sectional representation of FIG. 12, still another form of the supporting means 14 is shown, again including two rollers 16, 17 which now—other than according to FIGS. 1 to 6—are snapped onto a single, continuous axle 32'; this axle 32' extends through a lower, narrower, central housing part 35 of housing 2 where it also supports that portion 37 of the tongue-shaped transfer member 4 which is present in the housing interior 36, which portion projects from there outwards through the front-side housing opening (not illustrated).

Figure 13:
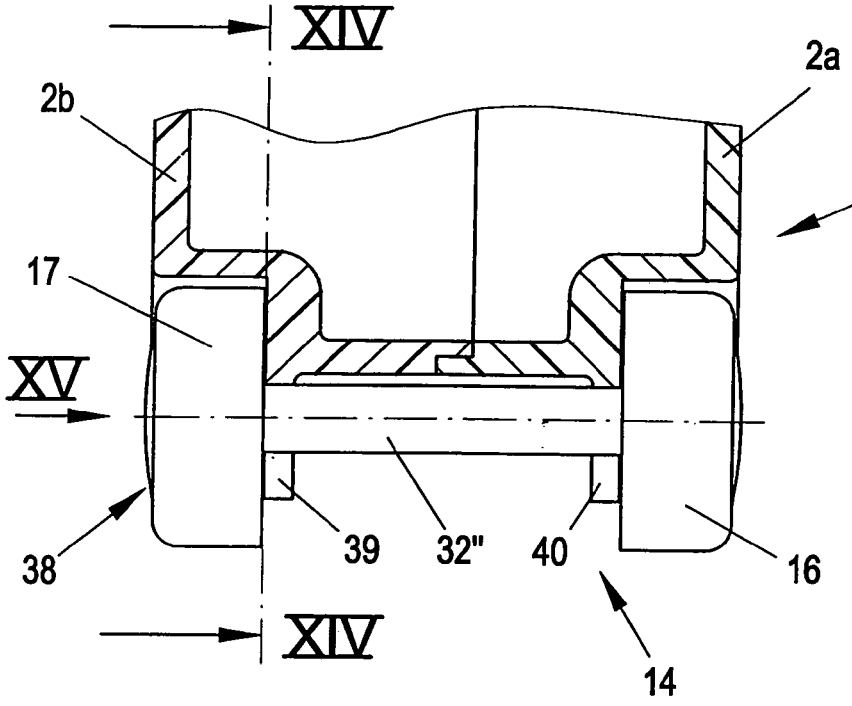
Figure 14:
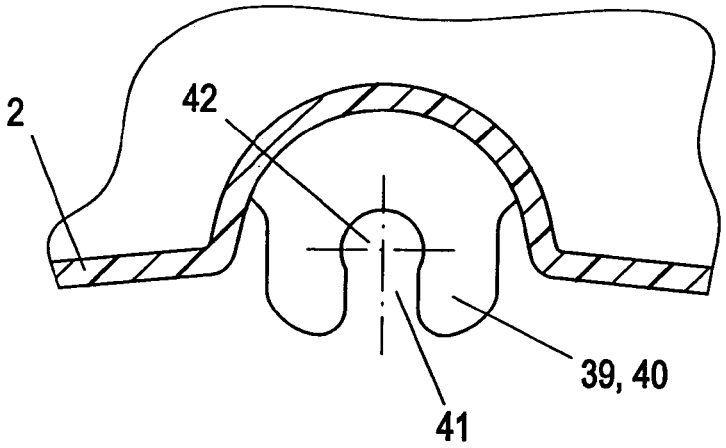
FIG. 14 shows a view according to line XIV—XIV of FIG. 13.
Figure 15:
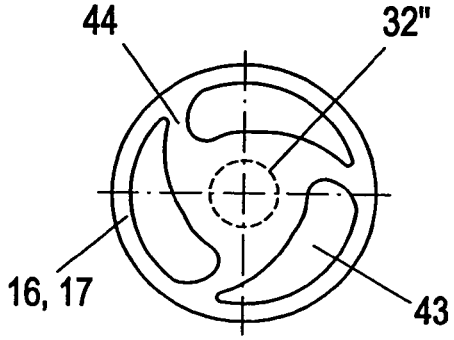
FIG. 15 shows a view according to arrow XV in FIG. 13.

Finally, in FIGS. 13 to 15, an embodiment of the supporting means 14 with rollers 16, 17 which at present is particularly preferred is shown in a partly sectional illustration similar to FIG. 10, FIG. 11 or FIG. 12, the rollers 16, 17 being provided integrally with an axle 32" as an injection-molded part. This roller-injection-molded structural element 38 is fastened to the lower side of housing 2 by snapping in on the lobe-shaped bearing projections 39, 40 provided there. For this purpose, as is also visible form FIG. 14 in combination with the one bearing projection, these bearing projections 39, 40 have a bearing recess 42 accessible from below via a narrowed slit opening 41. The rollers 16, 17 may also be formed with recesses 43 and spokes 44, respectively, so as to save material, as is shown in FIG. 15 for the one roller 17. With such a design of the rollers 16, 17, also a slight resilience can be achieved which additionally helps to achieve the desired controlling effect when using the hand-operating tool.

Finally, from FIG. 13 it is visible that the housing 2, as mentioned before, is designed in a per se conventional manner in two housing halves **2*a* and 2*b***, respectively.

Differently from the embodiments described and illustrated so far, it may also be provided, e.g., that the or each roller, respectively,—instead of being put onto an axle in a snap fit—may also be secured on the respective axle by means of a safety ring or the like. The rollers may be made of a relatively soft synthetic material having comparatively high friction, such as polyethylene, e.g. On the other hand, the sliding skids 29 in the exemplary embodiment according to FIGS. 9 and 10 or, generally, parts defining such a sliding surface 31 (according to the illustration of FIG. 10, also the two sliding skids 29, 30 could be interconnected into a unitary sliding part on the housing lower side 13) should be made of a harder, low-friction synthetic material, such as polystyrene, e.g.

Besides, it is, of course, also possible to provide a biaxial reel arrangement instead of the coaxial arrangement of supply reel 7 and winding up reel 9 illustrated.

What is claimed is:

1. A hand-operated tool for transferring a film from a tape to a substrate, said tool comprising a housing from which a film transfer member (4) projects outwards and in which a film supply reel, from which the tape is pulled over the transfer member for transferring the film, as well as a winding-up reel, which is coaxial to the supply reel, are rotatably mounted, and a sliding coupling provided for a torque transmission from the supply reel to the winding-up reel, the tape being wound up on the winding-up reel after transfer of the film at the transfer member, wherein at a bottom side of the housing which, when transferring the film to the substrate, faces this substrate, in a transition region between a housing part accommodating the transfer member and a housing part housing the reels, two separate supporting means defining a tilting support for the housing, which tilting support is fixed relative to the housing, are externally provided on both sides of a housing main middle plane, which supporting means, in combination with the transfer member, provide a three-point support on the substrate, wherein the supporting means are formed by rollers laterally mounted on the housing.

2. A hand-operated tool according to claim 1, wherein the rollers are put onto an axle which passes through the housing.

3. A hand-operated tool according to claim 2, wherein the axle in the housing interior additionally supports the transfer member.

4. A hand-operated tool according to claim 2, wherein the axle is mounted on the bottom side of the housing.

5. A hand-operated tool according to claim 4, wherein the axle is snapped into bearing projections provided on the bottom side of the housing.

6. A hand-operated tool according to claim 4 or 5, wherein the rollers are integrally formed with the axle.

7. A hand-operated tool according to claim 6, wherein the rollers are integrally formed as an injection molded part.

8. A hand-operated tool according to claim 1, the rollers are put onto separate lateral axles.

9. A hand-operated tool according to claim 8, wherein the rollers are mounted in snap fit on the respective axles.

10. A hand-operated tool according to claim 1, wherein the rollers are inserted into undercut housing recesses.

11. A hand-operated tool according to claim 10, wherein the rollers are snapped into the undercut housing recesses.

* * * * *